US006280117B1

(12) United States Patent
Obermeyer et al.

(10) Patent No.: US 6,280,117 B1
(45) Date of Patent: Aug. 28, 2001

(54) UNIVERSAL DRAIN FITTING

(75) Inventors: Michael B. Obermeyer, Charlotte; T. Richard Morris, Matthews, both of NC (US)

(73) Assignee: American Wick Drain Corporation, Matthews, NC (US)

( * ) Notice: Subject to any disclaimer, the term of this patent is extended or adjusted under 35 U.S.C. 154(b) by 0 days.

(21) Appl. No.: 09/246,769

(22) Filed: Feb. 8, 1999

(51) Int. Cl.[7] ..... E02B 5/00
(52) U.S. Cl. ..... 405/119; 405/36; 404/4
(58) Field of Search ..... 285/12, 129.1, 285/342; 405/36, 39, 40, 43, 47, 50, 119; 404/2–4; 249/9–13

(56) References Cited

U.S. PATENT DOCUMENTS

| | | | | |
|---|---|---|---|---|
| 1,270,046 | | 6/1918 | Murray . | |
| 4,477,934 | * | 10/1984 | Salminen | 4/663 |
| 4,490,067 | | 12/1984 | Dahowski . | |
| 4,925,342 | | 5/1990 | Hendy . | |
| 5,529,436 | * | 6/1996 | Meyers | 405/119 |

* cited by examiner

*Primary Examiner*—Robert E. Pezzuto
(74) *Attorney, Agent, or Firm*—Kennedy Covington Lobdell & Hickman, LLP

(57) ABSTRACT

A universal drain fitting for use with prefabricated drains of all sizes for joining the drain and a cylindrical-shaped pipe for making the transition between a drain and a drain outlet or between two drains in a drainage system. In the first and second preferred embodiments, the universal drain fitting includes a drain fitting portion formed by two walls in spaced parallel relationship with one another to define an open cavity and a pipe fitting portion connected to the drain fitting portion which includes a hollow cylindrical section with an opening adapted to be connected to a pipe. The open cavity has a plurality of sides formed by the space between the walls and includes at least two open sides adjacent to and in communication with one another for receiving a portion of a drain into the open cavity. The first and second preferred universal fitting may be an end outlet fitting adapted to be positioned on an end portion of any size drain or a tee outlet fitting adapted to be positioned on a top or bottom portion of any size drain. In a variation of the first and second preferred embodiments, the universal fitting includes a drain fitting portion formed by a wall and a pipe fitting portion connected to the drain fitting portion. In additional preferred embodiments, the universal fitting is a vertical connector fitting or horizontal connector fitting adapted to connect two sections of any size drain.

24 Claims, 15 Drawing Sheets

UNIVERSAL DRAIN FITTING

BACKGROUND OF THE INVENTION

The present invention relates generally to subsurface drain systems and the like, and more particularly to a universal drain fitting for prefabricated soil drains.

Civil engineers and architects have long recognized the importance of proper subsurface drainage and providing a subsurface drainage system which allows water to flow freely while soil particles are held in place. While aggregate drain systems, with or without pipes, have been used for centuries, a common problem of this type of drain has been the clogging due to soil infiltration and/or subsidence from soil removal. One conventional approach for providing subsurface drainage is to place perforated pipe, surrounded by select aggregate and geotextile material at a point where drainage is required. While this type of system may be effective, its use is often precluded in all but the most severe conditions due to its high installation costs. An effective, economical alternative to conventional systems are prefabricated geocomposite drainage systems which combine a polymeric core and a geotextile fabric wrap to provide efficient soil filtration, drainage and durability in one prefabricated, easy-to-install package.

Modern prefabricated drains typically consist of 1) a geotextile filter fabric which allows easy water entry while retaining soil particles and 2) a plastic drain core which includes core cones and acts as a collector and transporter of the water. Although some cores are two sided or punched to allow water entry from both sides, most cores are single sided and the typical core thickness is ¼ inch to 1 inch or 6 to 25 millimeters. In addition, the back of the core may include a thin, high strength polymeric film to prevent soft water-proofing membranes from extruding into the back of the core cones. The prefabricated soil drainage system offers several advantages over other conventional methods for providing subsurface drainage. The prefabricated soil drain is lightweight, economical and easy to install, store and transport. The thickness of the drain requires significantly less space than aggregate drainage. The geotextile fabric permits a high volume of water into the core which has multiple channels for vertical and horizontal water flow, while restraining the soil particles to provide a drain which allows high flow capacity with no clogging. Further, both the core and the geotextile fabric are constructed of materials which are chemically resistant to all naturally-occurring soil materials, and special fabrics and core materials may be used if additional chemical resistance is required.

Prefabricated drains may be grouped into five categories: a sheet drain, a strip drain, a vertical (wick) drain, a highway edge drain and a combination drain. Sheet drains cover an entire surface area and are used where large surface areas require drainage. For example, vertical applications of sheet drains may include basement walls and retaining walls, and horizontal applications may include plaza decks and roof gardens. Strip drains are made in 4 to 36 inch widths and are used where full area coverage is not necessary or practical. The core of a strip drain is usually 1 inch thick and typical applications of the strip drain include golf courses, athletic fields and residential yards. A vertical or wick drain is a special purpose strip drain which is usually 4 inches wide and ⅛ to ¼ inches thick and used for consolidation of soft, compressible soils. Another special purpose strip drain is a highway edge drain which is usually 12 to 36 inches wide and 1 inch thick and used for highway edge drainage. Another type of strip drain is the combination drain which is made by combining a regular strip drain with a high flow strip drain section. The combination drain is usually 24 inches wide and may be used alone or as the bottom section with a normal sheet drain. Thus, the prefabricated soil drains are designed for a variety of purposes and are available in several different sizes.

In use, a prefabricated soil strip drain is placed in a trench to fit against the side of the trench and extend to the bottom of the trench. The material that was previously removed from the trench is then used to refill the trench and hold the drain in place in the trench. Outlet pipes for carrying the water away from the drain are placed as required by the application and topography. The end of the outlets may direct the water flow to bare ground, concrete drain pads, existing drain boxes or some combination of these. Prior to placing the strip drain in the trench, an outlet connector is installed on the drain for connecting lengths of the strip drain to each other and to the outlet pipes. The connectors must be capable of maintaining the integrity of the system under long-term loads and provide efficient and unrestricted flow while providing a positive connection that will prevent pulling apart during installation procedures. Because the width of the strip drain may typically vary from 4 to 36 inches, it has been necessary to provide a variety of different sizes of connectors to fit the width of the particular strip drain. Thus, a user must have a supply of connectors available for each different size width of strip drain to be installed. Another disadvantage of the current connectors is that the installation of a connector on a non-end portion of the drain requires that the drain be cut in two and that the connector be installed between the two cut portions. If the both portions of the drain are not inserted correctly into the connector, the structural strength of the system and the drain path may be compromised.

In accordance with the present invention, a universal drain fitting device for connecting a prefabricated soil drain to an outlet pipe is provided which is easily and quickly installed on any size drain and at any place on the drain without the risk of harming the structure of the system.

SUMMARY OF THE INVENTION

In accordance with the present invention, a universal drain fitting is provided for use with prefabricated drains for connecting the drain to a cylindrical-shaped pipe for making the transition between a drain and a drain outlet or between two drains in a drainage system. The universal drain fitting is designed to be used with geocomposite soil drains of all widths whether a tee (top or bottom), end or corner portion of the drain is selected for making the connection without the risk of harming the structure of the system. Because the universal fitting of the present invention fits all sizes of drains and is versatilely positioned on the drain, it replaces several different fittings heretofore required to make the connection between a drain and a pipe or two drain sections.

The universal fitting comprises a drain fitting portion adapted to surround a portion of the drain and may include a pipe fitting portion connected to the drain fitting portion, which is adapted to be connected to a pipe. The drain fitting portion includes two walls disposed in spaced parallel relationship which form an open cavity between the walls for positioning the drain fitting portion on the drain. The walls include an inner surface and an outer surface and the inner surface may include a ridge that extends into the open cavity for engaging the drain fitting portion on the drain and holding it in place thereat. The open cavity has a plurality of sides formed by the space between the walls and includes at least two open sides adjacent to and in communication with one another for receiving a portion of a drain into the open cavity. The pipe fitting portion includes a hollow cylindrical section extending outwardly from and having an axis in communication with the drain fitting portion. The cylindrical section includes an intermediate connecting portion attached to the drain fitting portion and a pipe engaging portion extending therefrom with an opening for engaging a pipe and connecting the pipe fitting portion and the pipe. In the preferred embodiments, the pipe engaging portion includes a smaller diameter opening adjacent to the intermediate connecting portion and a larger diameter opening adjacent to the smaller diameter opening to accommodate more than one type of outlet pipe without the use of extra fittings or adapters. The different diameters incorporated into the pipe fitting portion are preferably selected to accommodate two types of outlet pipe commonly used in the industry, corrugated polyethylene and straight-wall PVC pipe.

In the preferred embodiments of the present invention, the walls of the drain fitting portion are substantially rectangular-shaped so that the open cavity has four sides. The walls are substantially flat and constructed of a semi-rigid material, such as by way of example, a lightweight plastic, and the drain fitting portion is integral with the pipe fitting portion. The geocomposite soil drain of the preferred embodiments of the present invention includes a plastic drain core covered by a geotextile filter fabric which allows water to pass therethrough while retaining soil particles. The drain has a substantially rectangular-shaped body of a predetermined thickness and includes an edge of a predetermined extending length. The drain body includes a top and a bottom and opposite ends and may be of any size width and thickness but typically ranges from a thickness of ¼ inch to 1 inch and a width of 4 inches to 3 feet. The geocomposite soil drain is typically provided in rolls having a length which varies with the type of application and may be in rolls from 50 feet to 1000 feet long.

In use, the drain fitting portion is adapted to slide onto the drain so that one of its walls engages one side of the drain body and the other wall engages the other side of the drain body to attach the drain fitting portion on the drain. Depending on the placement of the drain at its point of application and the placement of the universal drain fitting portion on the drain, the edge of a predetermined length may either refer to the width or the length of the drain. In either case, the drain fitting portion is adapted to make a connection between the drain and a pipe or between two drain sections regardless of the length of the edge. The preferred embodiments of the present invention may include a geotextile filter fabric secured to the walls of the drain fitting portion and adapted to be placed over the end of a drain or around a top or bottom of a drain to prevent soil from entering an open edge of the drain.

In one preferred embodiment, the universal drain fitting is designed to be an end outlet fitting for connecting an end of any size drain to a pipe. In this first preferred embodiment, the pipe fitting portion extends outwardly from and defines one of the sides of the open cavity so that the centroid of the pipe fitting portion is parallel to or at a 180 degree angle to the flow of the drain. In other words, the axis of the cylindrical section of the pipe fitting portion is parallel to the two walls of the drain fitting portion. In the first preferred embodiment, one of the three remaining sides is closed and extends between the two walls to form a closed side. The two remaining open sides are adjacent to and in communication with one another for receiving an end portion of the drain into the open cavity. The pipe fitting portion is adjacent to the closed side so that the drain fitting portion is adapted to be positioned at the intersection of the top or bottom and either of the ends or, in other words, on the ends at the corners of the drain. In a variation of the first preferred embodiment, the remaining three sides are open and adjacent to and in communication with one another for receiving an end portion of the drain into the open cavity. While the drain fitting portion is preferably fitted onto an end of the drain, the universal fitting of the first embodiment may be positioned along the top, bottom or ends of the drain.

In another preferred embodiment, the universal drain fitting is designed to be a side or tee outlet fitting for connecting a non-end portion of the top or bottom of a drain to a pipe. In this second preferred embodiment, the pipe fitting portion extends outward from one of the walls of the drain fitting portion so that the centroid of the pipe is perpendicular to or at a 90 degree angle to the flow of the drain. In other words, the axis of the cylindrical section of the pipe fitting portion is perpendicular to the two walls of the drain fitting portion. One of the four sides of the open cavity is closed for connecting the two walls to one another and the three open sides are adjacent to and in communication with one another. While the tee fitting of the second preferred embodiment is preferably positioned along the top or bottom of the drain, the drain fitting portion may be positioned along the top, bottom or ends of the drain. In use, a notch may be cut on a top or bottom portion of the drain for increasing the flow of water therethrough and the drain fitting portion is positioned over the notched portion of the drain. Because it is not necessary to cut the drain into two pieces to fit into a opposite sides of a tee connector specifically sized to match the size of the drain, the tee fitting of the present invention connects a top or bottom portion of any size drain without harming the structure of the drainage system.

While the universal drain outlet fitting of the first and second preferred embodiments includes a pipe fitting portion extending outwardly from the drain fitting portion such that the X axis of the cylindrical section of the pipe fitting portion is at a 180 degree angle or 90 degree angle to the walls of the drain fitting portion, it will be understood that the centroid of the pipe could be anywhere within 360 degrees of the flow of the drain. In other words, the X axis of the cylindrical section of the pipe fitting portion may be at a 45 degree angle or at any angle within 360 degrees of the walls of the drain fitting portion.

The universal drain fitting of the present invention also includes universal vertical and horizontal connector fittings. The universal vertical connector fitting is designed for joining two sections of a drain in vertical alignment with one another. The universal vertical connector fitting includes a drain fitting portion having a width equal to or less than the extending length L of the edge of either section of the drain and which is adapted to surround a portion of the drain body of each drain section and make a connection between the drain sections regardless of the extending length L of the edge of the drain sections. The universal vertical connector fitting includes two walls disposed in a parallel relationship with one another which define an open cavity between the two walls for receiving a portion of the sections of the drain. The walls are connected by at least one tab extending between the walls and preferably are connected by a pair of tabs at opposite sides of the walls and define an upper cavity above the tabs and a lower cavity below the tabs for receiving a portion of the sections therein and join the sections together. The tabs are adapted to form a slot or opening between the upper cavity and the lower cavity for open communication therethrough.

The universal horizontal connector fitting is designed for joining two sections of a drain to each other in a horizontal manner. The universal horizontal connector fitting includes a drain fitting portion with two drain section fitting portions, each having a width equal to or less than the extending length L of the edge of either section of the drain and which is adapted to surround a portion of the drain body of each drain section and make a connection between the sections of a drain regardless of the extending length L of the edge of the drain sections. In the universal horizontal connector fitting, the drain section fitting portions are joined in a substantially T-shaped configuration with open communication between the open cavity of each drain section fitting portion. Each drain section fitting portion includes walls disposed in parallel relationship to one another and each pair of walls defines an open cavity between the two walls for receiving a portion of the drain sections into each open cavity and joining the sections in horizontal alignment with one another.

The present invention may also include a method for installing the universal drain fitting on a geocomposite soil drain of any size. The steps for installing a universal end fitting begin with sliding the drain fitting portion of the universal fitting onto an end portion of a drain. Preferably, an end fitting including one closed side adjacent to the pipe fitting portion is provided and the fitting is positioned at the end on either the top or bottom comer of the drain. The installation of a tee fitting begins with cutting a notch on a top or bottom portion of a drain and then sliding the tee fitting over the notch. While the preferred notch is substantially v-shaped for providing increased water flow therethrough, the notch may be of any shape, not exceeding the size of the opening in the pipe fitting portion and over which the drain fitting portion can be positioned. Thus, the tee fitting is quickly and easily installed without the risk of weakening the structure of the system.

Once the fitting is in place, the pipe is inserted into the pipe fitting portion. In the preferred embodiment, the universal fitting includes fabric extending outward from the drain fitting portion and the fabric is wrapped over the end of the drain for an end fitting or around the top or bottom of the drain for a tee fitting. The drain fitting portion and pipe fitting portion are secured to the drain and the pipe, respectively, by taping the fabric and pipe in place. Using a standard trenching machine, a trench approximately 2 to 6 inches wide is dug to a predetermined required depth. The required depth of the trench depends upon the drain width, application and soil permeability. A minimum of 3 inches of soil should be provided to cover the drain to prevent damage to the drain by surface equipment. The material removed from the trench is typically used for backfill. After the drain is placed into the trench, the first layer of backfill is placed in the trench and should hold the drain tightly against the side of the trench. Prior to placing the second layer of backfill, the first layer should be compacted. The second layer is placed to a depth that will, when compacted, be level with the original soil or leave the proper space at the top of the trench for placement of the top soil.

The universal drain fitting of the present invention provides an effective, economical, easily installed device for connecting a geocomposite soil drain of any size width to a pipe thereby eliminating the need for different sizes of fittings for making the connection between a drain and a drain outlet or between two drains.

DESCRIPTION OF THE PREFERRED EMBODIMENT

Figure 1:
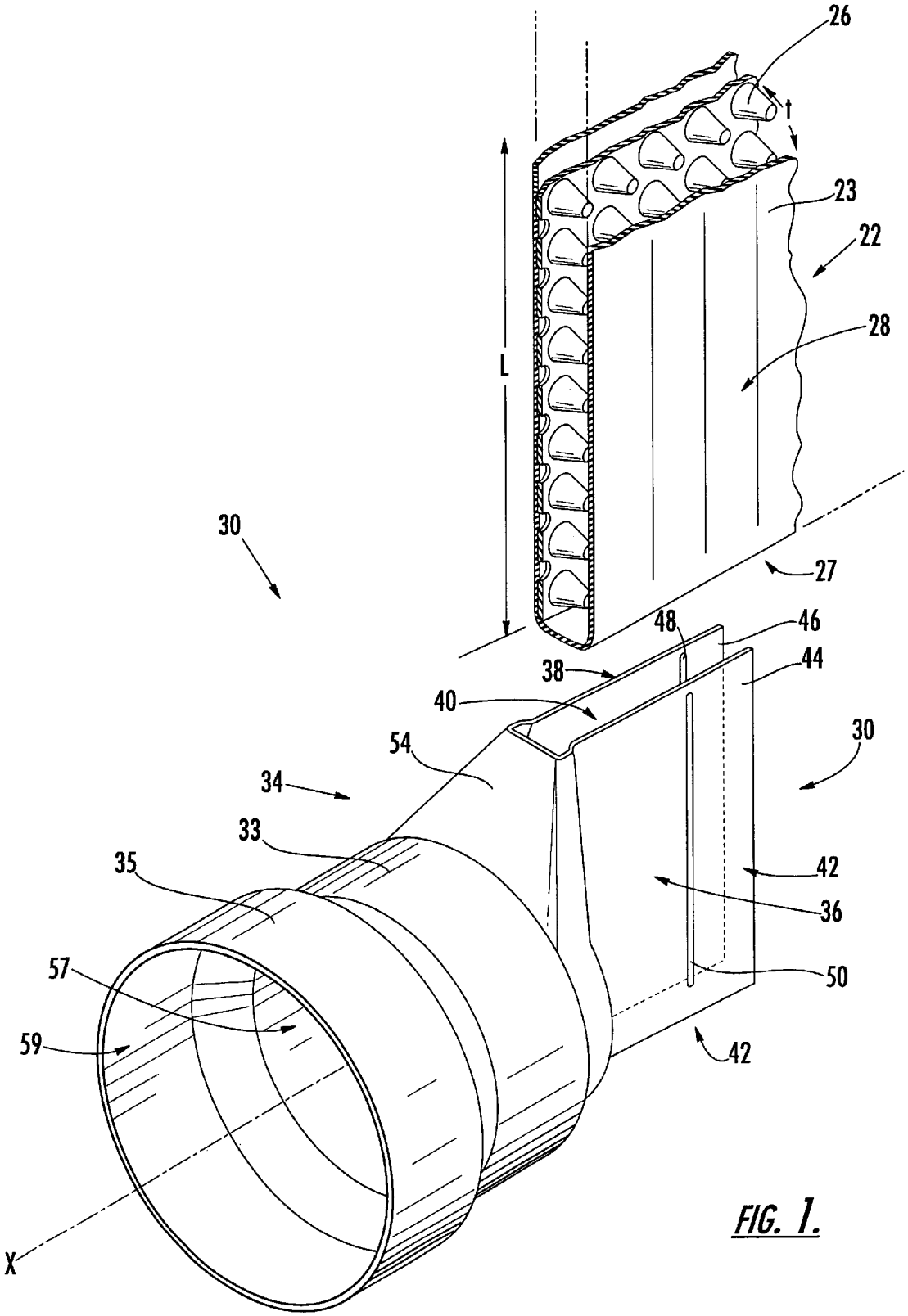
FIG. 1 is a perspective view of the first preferred embodiment of the universal fitting of the present invention showing an end outlet fitting including a drain fitting portion which has two open sides and is adapted for placing the end outlet fitting on an edge of a drain and a universal pipe fitting portion with an opening incorporating two different diameters facing parallel to the flow of the drain for joining a drain end to a drain outlet.
Figure 4:
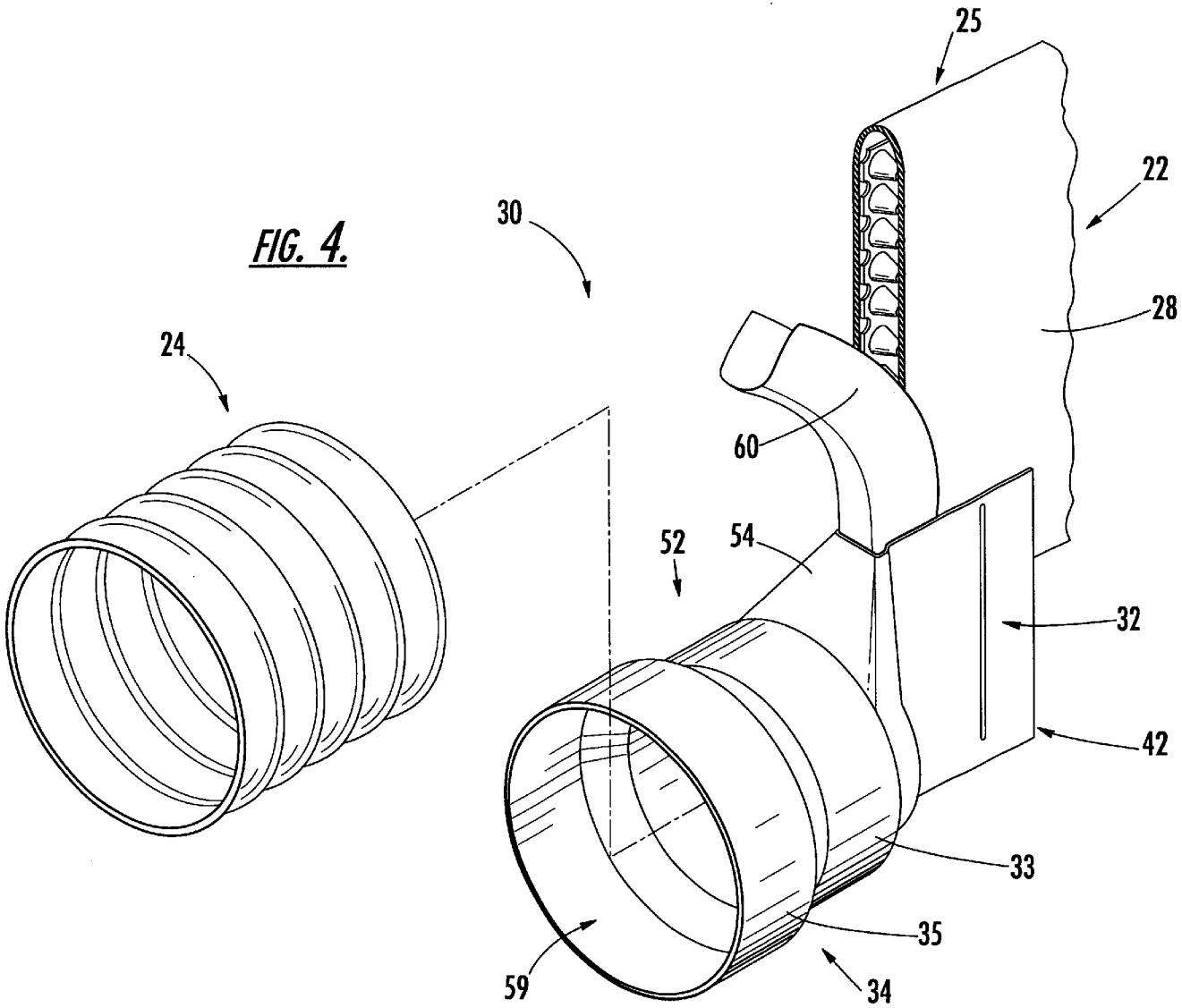
FIG. 4 is a perspective view of a drain and a variation of the universal end outlet fitting which includes fabric being installed on the end of a drain.

Looking now in greater detail at the accompanying drawings, a universal drain fitting embodying the present invention is provided for connecting a prefabricated or geocomposite drain 22 to a cylindrical shaped pipe or for connecting two sections of the drain 22 and is specifically designed for use with drains of all sizes whether the fitting is to be positioned in a side, tee (top or bottom), end or corner portion of the drain. As best seen in FIGS. 1 and 4, the drain 22 includes a geotextile filter fabric 23 and a plastic drain core having a plurality of core cones 26. In the preferred embodiments, the drain 22 has a substantially rectangular shaped body 28 of a predetermined thickness t and includes a top 25, a bottom 27 and side ends 29, each having an edge and including at least one edge of a predetermined extending length L.

Figure 2:
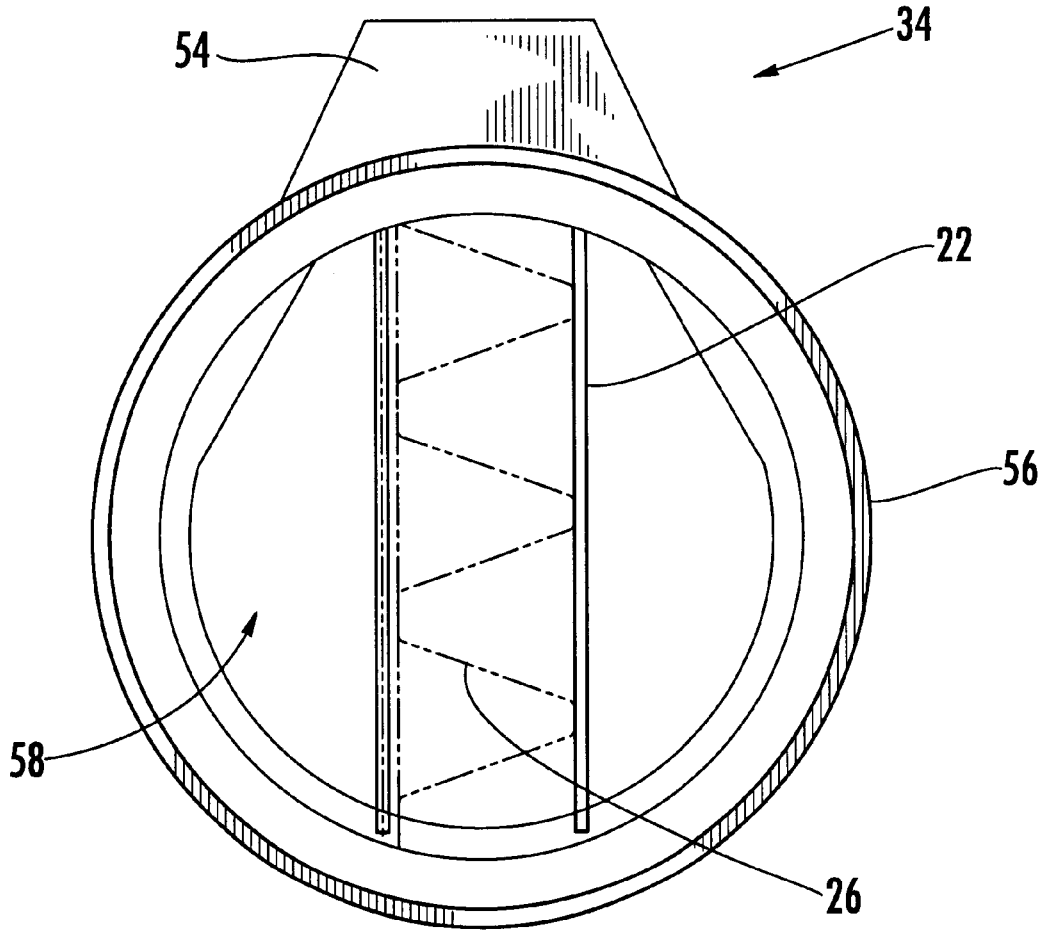
FIG. 2 is a front view of the universal end outlet fitting shown in FIG. 1.
Figure 3:
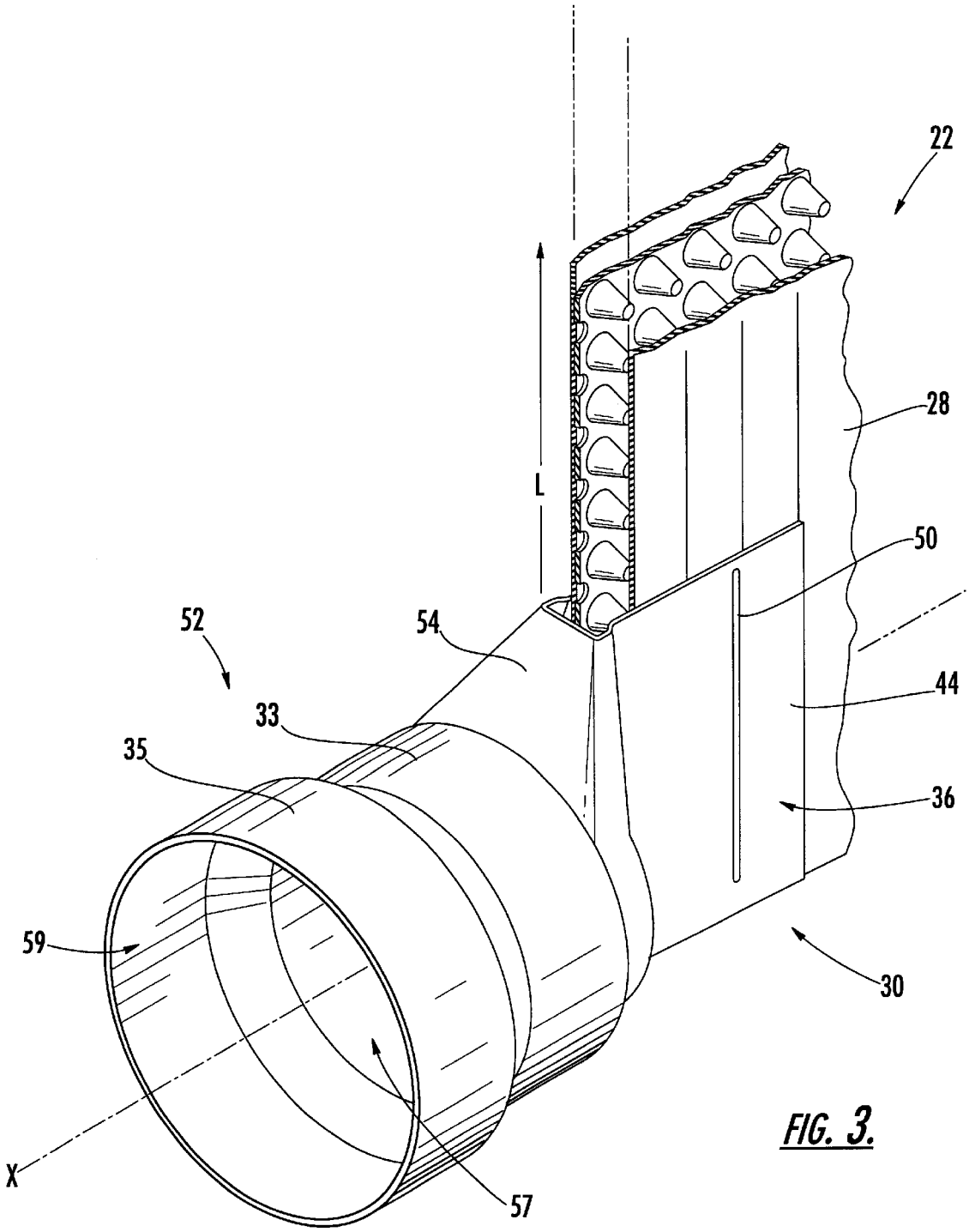
FIG. 3 is a perspective view of the first preferred embodiment showing the drain fitting portion of the end outlet fitting installed on a drain.

As illustrated in FIGS. 1–5, the first preferred embodiment of universal drain fitting 20 is a universal end outlet fitting 30 which includes a drain fitting portion 32 having a width equal to or less than the extending length L of the edge and which is adapted to surround a portion of the drain 22 having the drain body 28 and make a connection between the drain 22 and a pipe regardless of the extending length L of the edge of the drain. A pipe fitting portion 34 is connected to and integral with the drain fitting portion 32 and adapted to be connected to a cylindrical pipe. While the drain fitting portion 32 may be positioned on any edge of the drain 22, the universal end fitting 30 is preferably positioned on the edge of a side end 29 of the drain, such as on the bottom edge of the side end 29, as shown in FIG. 3. As best seen in FIG. 1, the drain fitting portion 32 includes two walls 36, 38 disposed in parallel relationship to one another which define an open cavity 40 between the two walls 36,38 which has a plurality of sides 42 with at least two open sides adjacent to one another for receiving a portion of the drain 22 into the open cavity 40. In the preferred embodiments, the walls 36, 38 are substantially rectangular shaped and flat and are constructed of a semi-rigid material, such as by way of example, a lightweight plastic. The plurality of sides 42 comprise four sides defined by the space between the rectangular-shaped walls 36, 38. In the first preferred embodiment, the walls 36, 38 include an outer surface 44 and an inner surface 46 having a ridge 48 which may form a recess 50 on the outer surface 44, as seen in FIGS. 1 and 3, and extends into the open cavity 40 for engaging the drain fitting portion 32 on the drain 22 and holding the drain fitting portion 32 in place. The ridge 48 may be a continuous ridge forming the continuous recess 50 (as shown in FIGS. 1 and 3), or may be a single protrusion or series of discontinuous protrusions or bumps on the inner surface 46 forming a single indentation or series of indentations on outer surface 44.

Figure 5:
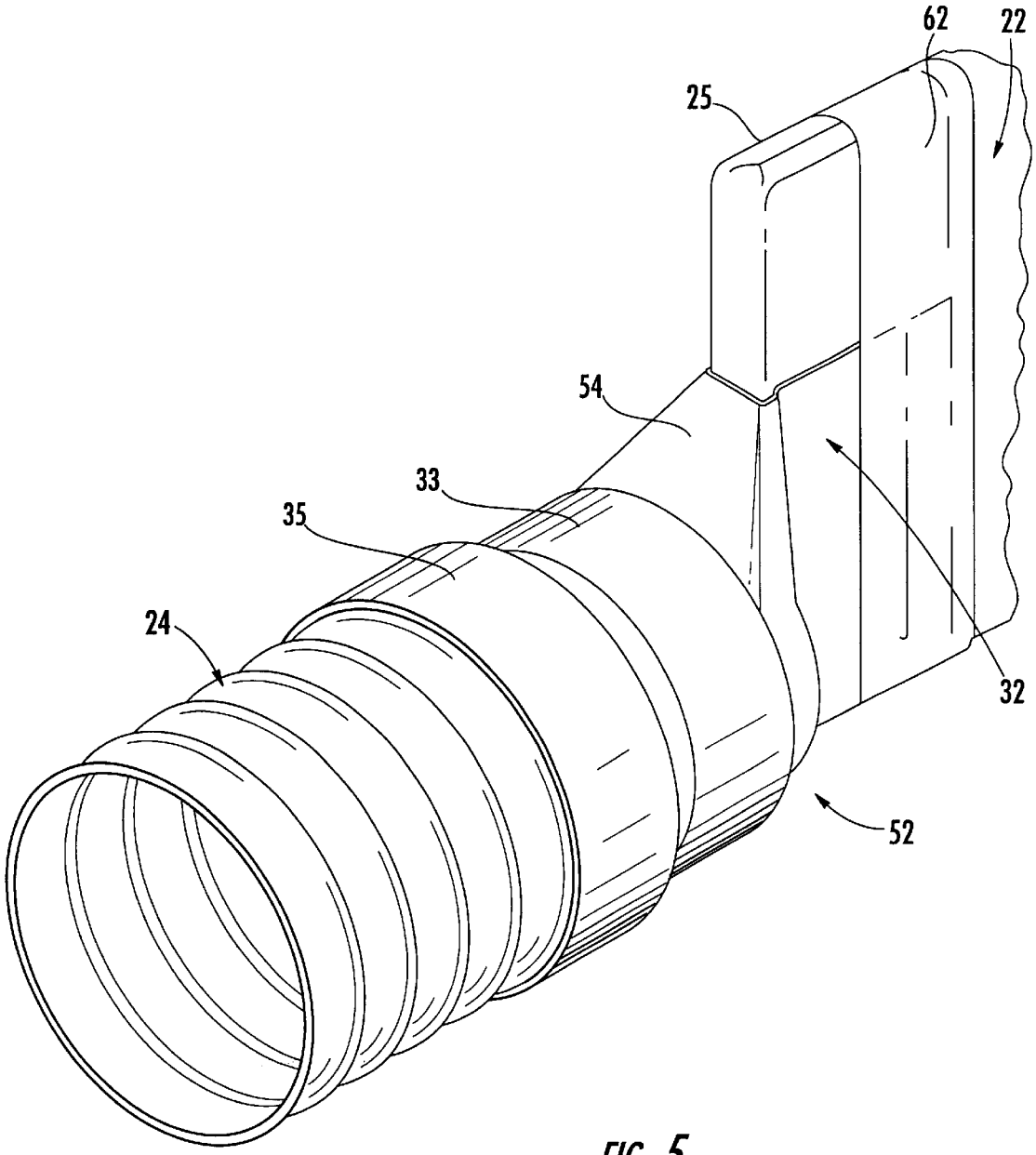
FIG. 5 is a perspective view of the universal end outlet fitting of FIG. 4 installed on the drain and taped in place and showing a pipe outlet connected to the drain.

As shown in FIG. 2, the pipe fitting portion 34 is in open communication with the open cavity 40, and the portion of the drain positioned therein, to provide an unobstructed path for water flow therethrough into the cylindrical pipe. The pipe fitting portion 34 includes a hollow cylindrical section 52 extending outwardly from and having an axis X in communication with the drain fitting portion 32. The cylindrical section 52 includes an intermediate connecting portion 54 attached to the drain fitting portion 32 and a pipe engaging portion 56 which has an opening 58 for engaging a cylindrical pipe and connecting the pipe fitting portion 34 and the cylindrical pipe. As shown in FIG. 1, the pipe fitting portion 34 includes a first pipe fitting portion 33 adjacent to the intermediate connection portion 54 and a second pipe fitting portion 35 adjacent to the first pipe fitting portion 33. The first pipe fitting portion 33 has a smaller diameter opening 57 to accommodate outlet pipes having a smaller diameter, such as, by way of example, a straight wall PVC pipe. The second pipe fitting portion 35 has a larger diameter opening 59 to accommodate outlet pipes having a larger diameter, such as, by way of example, a corrugated polyethylene pipe. Thus, the pipe fitting portion 34, incorporating two diameters, provides a good fit to either pipe material without the use of extra fittings or adapters. In use, a smaller pipe would extend through the larger diameter opening 59 into the smaller diameter opening 57 for engagement with the first pipe fitting portion 33. As shown in FIG. 5, a larger cylindrical shaped pipe 24 extends into the larger diameter opening 59 for engagement with the second pipe fitting portion 35. While a first pipe fitting portion 33 and a second pipe fitting portion 35 incorporating two diameters is shown, it will be understood that any number of diameters could be incorporated into the pipe fitting portion 34 for accommodating any size pipe.

In the first preferred embodiment, the pipe fitting portion 34 extends outwardly from and forms one of the sides 42 of the open cavity 40 such that the axis X of the cylindrical section 52 is parallel to the walls 36, 38 as shown in FIGS. 1–3. As best seen in FIG. 1, two of the remaining sides are open and in communication with one another for receiving a portion of the drain 22 into the open cavity 40 and one of the sides 42 adjacent to the side defined by the pipe fitting portion 34 is closed and extends between the two walls 36, 38 to form a closed side. For example, with reference to FIG. 1, the closed side may be located at the top or the bottom of the drain fitting portion 22 so that the universal end outlet fitting 30 is specifically adapted to be positioned at the intersection of the top 25 (see FIG. 4) or bottom 27 of either of the side ends 29 of the drain, or in other words at one of the corners of the drain 22, such as, by way of example, the bottom corner of the side end 29 as shown in FIG. 3. In a variation of the first preferred embodiment, the three remaining sides 42 are open and in communication with one another for receiving a portion of the drain 22 into the open cavity 40. Thus, the universal end outlet fitting 30 may be positioned along the edge of the top 25 (shown in FIG. 4), bottom 27 or side ends 29 of the drain 22 but is preferably positioned on the edge of one of the side ends 29 as shown in FIG. 3.

Figure 6:
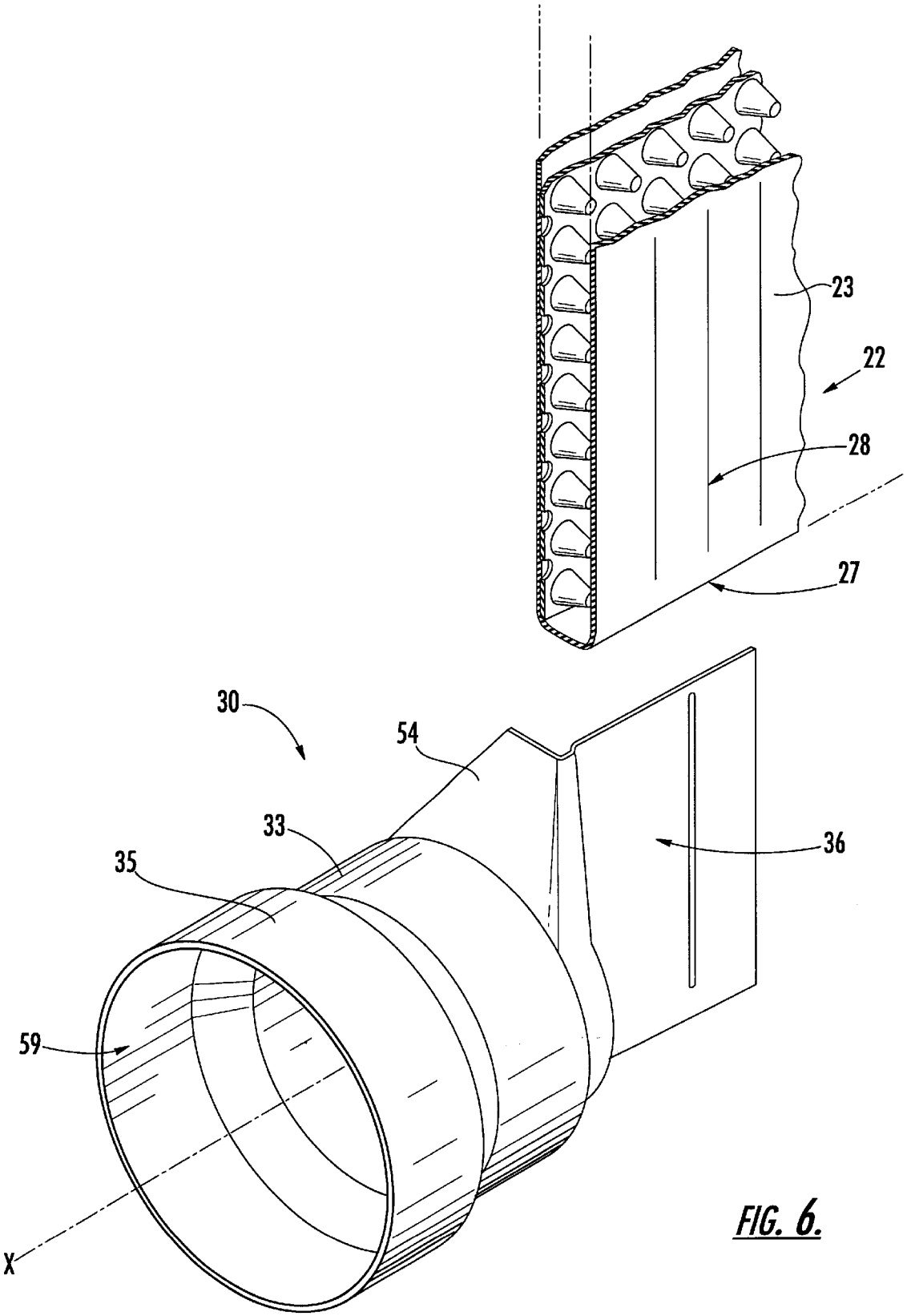
FIG. 6 is a perspective view of a variation of the first preferred embodiment of the universal end fitting of the present invention showing an end fitting including a drain fitting portion having one wall.

In another variation of the first preferred embodiment shown in FIG. 6, the universal end outlet fitting 30 includes the drain fitting portion 32 having a width equal to or less than the extending length L of the edge and which is substantially the same as the first preferred embodiment shown in FIG. 1 but includes only one wall 36 to be positioned against a portion of the drain body 28 and make a connection between the drain 22 and a pipe regardless of the extending length L of the edge of the drain. The pipe fitting portion 34 is connected to and integral with the drain fitting portion 32 and adapted to be connected to a cylindrical pipe. The universal end outlet fitting 30 of this variation of the first preferred embodiment may be secured in place by any suitable means and is preferably secured to the drain 22 by taping the wall 36 to the drain body 28.

As illustrated in FIGS. 4 and 5, the universal end outlet fitting 30 of the first preferred embodiment may include a geotextile filter fabric 60 connected to the walls 36, 38 of the drain fitting portion 32. The fabric 60 is adapted to be wrapped over the end of the drain 22 once the universal end outlet fitting is positioned on the drain. The universal end outlet fitting 30 may be installed on a prefabricated or geocomposite drain of any size. The steps for installing the universal end outlet fitting 30 include sliding the drain fitting portion 32 onto the end of the drain 22 and attaching the pipe fitting portion 34 to a cylindrical pipe 24 (see FIG. 4). As shown in FIG. 5, the universal end outlet fitting 30 may be secured in place with tape 62 by taping the drain fitting portion 32 and the fabric 60 to the drain 22. In addition, the pipe fitting portion 34 and pipe 24 may be secured in place by taping the pipe fitting portion to the pipe.

Figure 7:
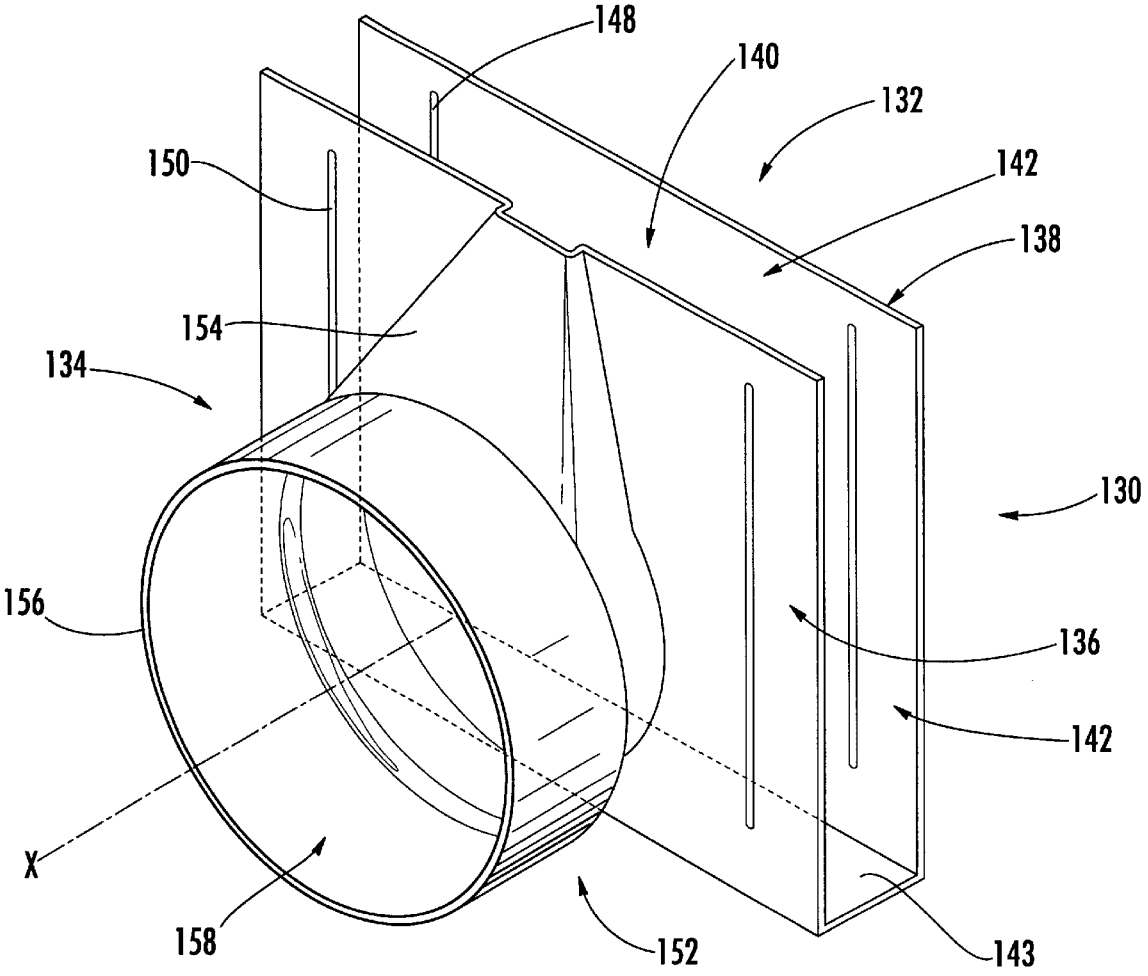
FIG. 7 is a perspective view of the second preferred embodiment of the universal fitting of the present invention showing a tee outlet fitting including a drain fitting portion which has three open sides and is adapted for placing the universal fitting anywhere along the top, bottom or side end of a drain.
Figure 8:
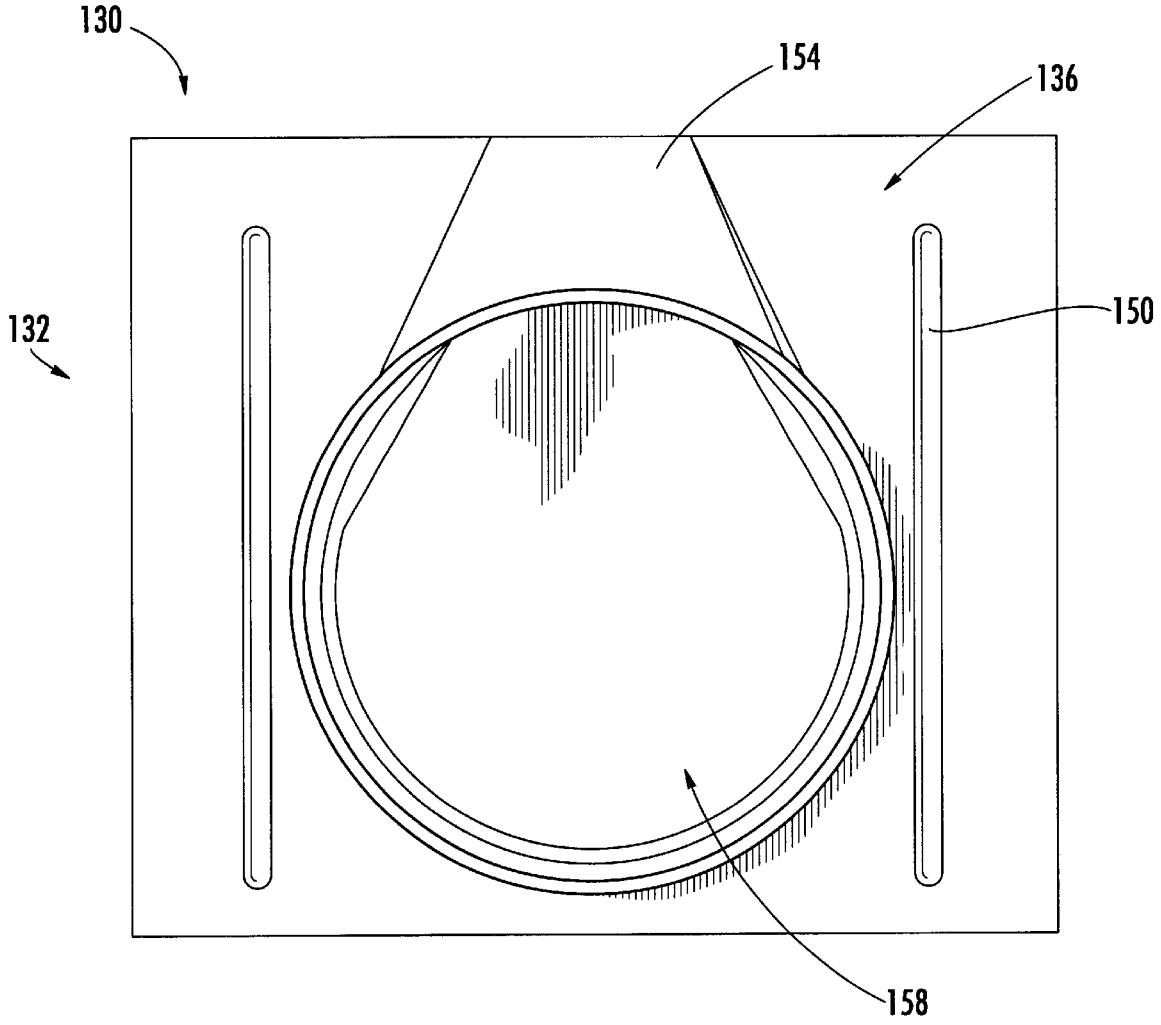
FIG. 8 is a front view of the universal tee outlet fitting shown in FIG. 7.
Figure 9:
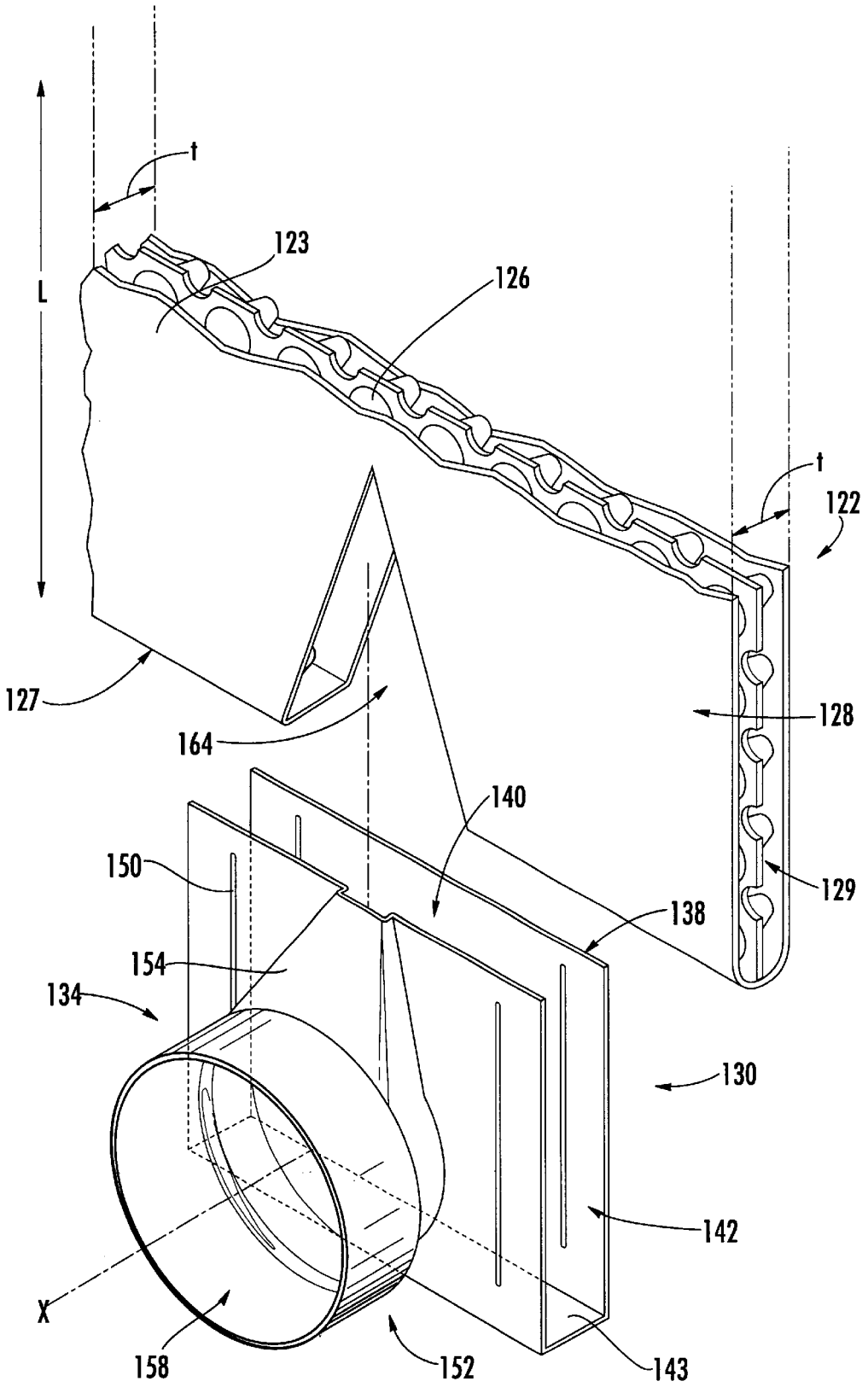
FIG. 9 is a perspective view of the universal tee outlet fitting to be installed on a drain having a notch cut into a bottom portion of the drain.

In a second preferred embodiment of the present invention shown in FIGS. 7–11, the universal drain fitting is a universal tee outlet fitting 130 designed for connecting a non-end portion of the top or bottom of a drain 122 to a pipe. As in the first preferred embodiment, the drain 122 has a substantially rectangular shaped body 128 of a predetermined thickness t and includes a top 125 (shown in FIG. 10), a bottom 127 and side ends 129, each having an edge and including at least one edge of a predetermined extending length L. As illustrated in FIGS. 7–9, the universal tee outlet fitting 130 includes a drain fitting portion 132 having a width equal to or less than the extending length L of the edge and which is adapted to surround a portion of the drain body 128 and make a connection between the drain 122 and the pipe regardless of the extending length L of the edge of the drain 122. A pipe fitting portion 134 is connected to and integral with the drain fitting portion 132 and adapted to be connected to the cylindrical pipe. While not shown, it will be understood that the pipe fitting portion 134 of the universal tee outlet fitting 130 may include a first pipe fitting portion having a smaller diameter and a second pipe fitting portion having a larger diameter, as shown in the first preferred embodiment and described above, for accommodating different types and sizes of outlet pipes.

While the drain fitting portion 132 may be positioned on any edge of the drain 122, the universal tee outlet fitting 130 is preferably positioned on the edge of the top 125 (shown in FIG. 10) or bottom 127 of the drain, such as the edge of the bottom 127 of the drain, as shown in FIG. 9. As in the first preferred embodiment, the drain fitting portion 132 of the universal tee outlet fitting 130 includes two walls 136, 138 disposed in spaced apart parallel relationship to one another and define an open cavity 140 between the two walls 136, 138. The walls 136, 138 include four sides 142 and are substantially rectangular-shaped and flat and are constructed of a semi-rigid material, with at least two open sides adjacent to one another for receiving a portion of the drain 122 into the open cavity 140. The walls 136, 138 include an outer surface 144 and an inner surface 146 having a ridge 148 which forms a recess 150 on the outer surface 144 of the walls, as seen in FIGS. 7–9, and extends into the open cavity 140 for engaging the drain fitting portion 132 on the drain 122. As in the first preferred embodiment, the ridge 148 may be a continuous ridge forming the continuous recess 150 (as shown in FIGS. 7–9), or may be a single protrusion or series of discontinuous protrusions or bumps on the inner surface 46 forming a single indentation or series of indentations on outer surface 44.

As shown in FIGS. 8 and 9, the pipe fitting portion 134 is in open communication with the open cavity 140. The pipe fitting portion 134 includes a hollow cylindrical section 152 extending outwardly from and having an axis X in communication with the drain fitting portion 132. The cylindrical section 152 includes an intermediate connection portion 154 attached to the drain fitting portion 132 and a pipe engaging portion 156 which includes an opening 158 for engaging a cylindrical pipe (not shown) and connecting the pipe fitting portion 134 and the cylindrical pipe.

Figure 12:
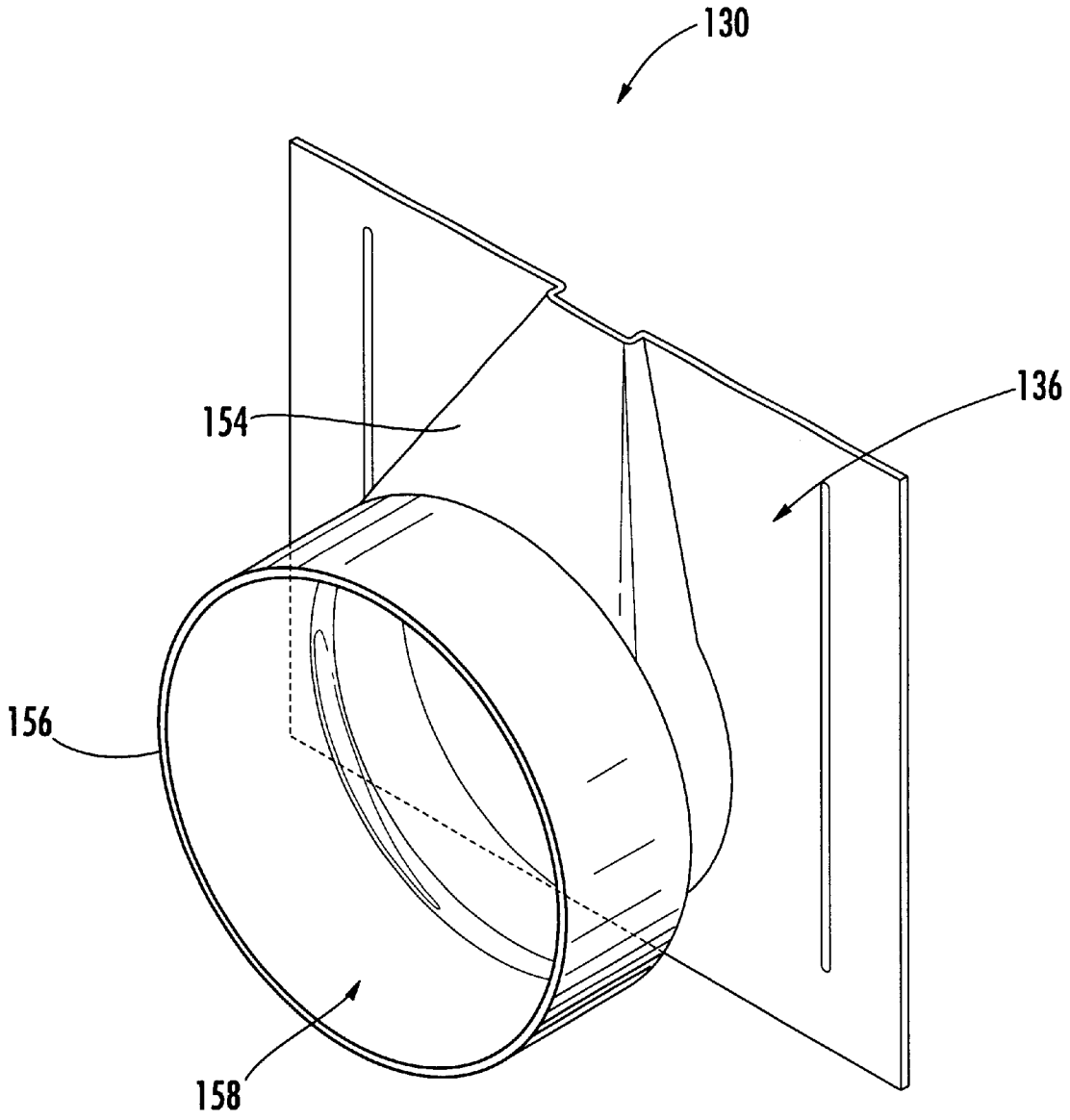
FIG. 12 is a perspective view of a variation of the second preferred embodiment of the universal tee fitting of the present invention showing a tee fitting including a drain fitting portion with one wall.

In the second preferred embodiment, the pipe fitting portion 134 extends outwardly from one of the two walls 136, 138 such that the axis X of the cylindrical section 152 is perpendicular to the two walls 136, 138, as shown in FIGS. 7–9. In the second preferred embodiment, one of the four sides 142 is closed for connecting the two walls 136, 138 to one another and forms a closed side 143. The three open sides 142 are adjacent to and in communication with one another for receiving a portion of the drain 122. For example, and with reference to FIGS. 7 and 9, the closed side 143 may be located at the bottom of the drain fitting portion 132 so that the universal tee outlet fitting 130 is specifically adapted to be positioned on the edge of the top 125 (shown in FIG. 10) or bottom 127 of the drain 122. While the closed side 143 is shown on the bottom of the drain fitting portion, it will be understood that the closed side 143 may be located at any one of the sides 142. In a variation of the second preferred embodiment shown in FIG. 12, the universal tee outlet fitting 130 includes the drain fitting portion 132 having a width equal to or less than the extending length L of the edge and which is substantially the same as the first preferred embodiment shown in FIG. 7 but includes only one wall 136 to be positioned against a portion of the drain body 128 and make a connection between the drain 122 and a pipe regardless of the extending length L of the edge of the drain. The pipe fitting portion 134 is connected to and integral with the drain fitting portion 132 and adapted to be connected to a cylindrical pipe. The universal tee outlet fitting 130 of this variation of the second preferred embodiment may be secured in place by any suitable means and is preferably secured to the drain 122 by taping the wall 136 to the drain body 128.

Figure 10:
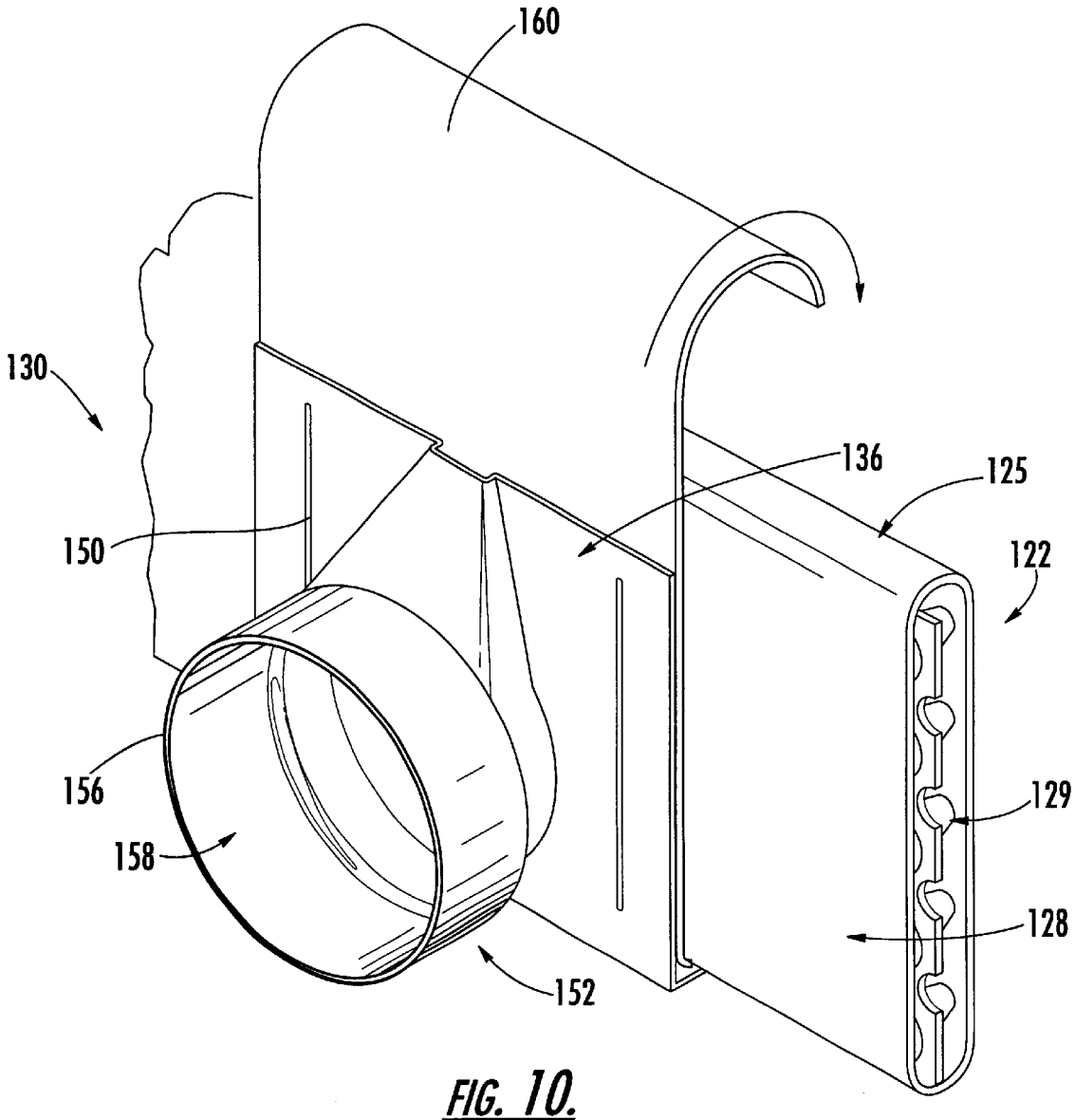
FIG. 10 is a perspective view of a variation of the universal tee outlet fitting which includes fabric being installed on the bottom portion of the drain.
Figure 11:
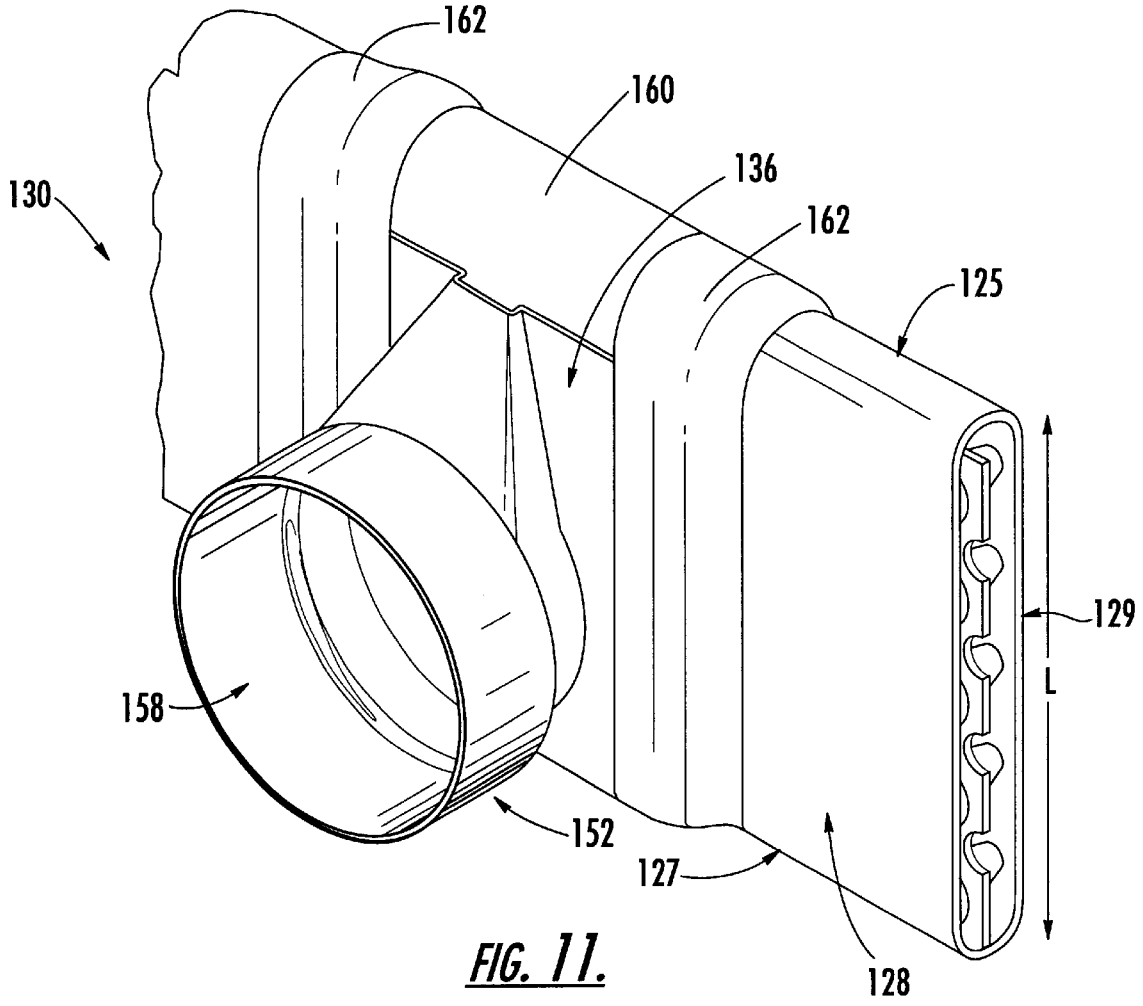
FIG. 11 is a perspective view of the universal tee outlet fitting of FIG. 10 installed on the bottom portion of the drain and taped in place.

As illustrated in FIGS. 10 and 11, the universal tee outlet fitting 130 of the second preferred embodiment may include a geotextile filter fabric 160 connected to at least one of the walls 136, 138 of the drain fitting portion 132. As shown in FIG. 10, the fabric 160 is provided for wrapping the fabric around the top 125 or bottom 127 of the drain 122. The universal tee outlet fitting 130 may be installed on a prefabricated or geocomposite drain of any size. The installation of the universal tee outlet fitting 130 typically begins with the step of cutting a notch 164 on a portion of the top 125 or bottom 127 of the drain 122 selected as the location for connecting the drain to a cylindrical pipe. While cutting a notch facilitates flow therethrough, the universal tee outlet fitting 130 may be installed on the drain 122 without cutting a notch or cutting only the filter fabric from one or both exterior walls of the drain. As shown in FIG. 9, the notch 164 is preferably cut through the fabric and the plastic drain core in a substantially v-shape and does not exceed the size of the opening 158. After the notch 164 is cut, the universal tee outlet fitting 130 is positioned over the notch 164. Once the universal tee outlet fitting 130 is in place, the pipe fitting portion 134 is attached to the pipe. As shown in FIG. 11, the universal tee outlet fitting 130 may be secured in place with tape 162 by taping the drain fitting portion 132 and the fabric 160 to the drain 122 or otherwise securing the drain fitting portion 132 to the drain 122. In addition, the pipe fitting portion 134 and the pipe may be secured in place with tape 162.

Figure 13:
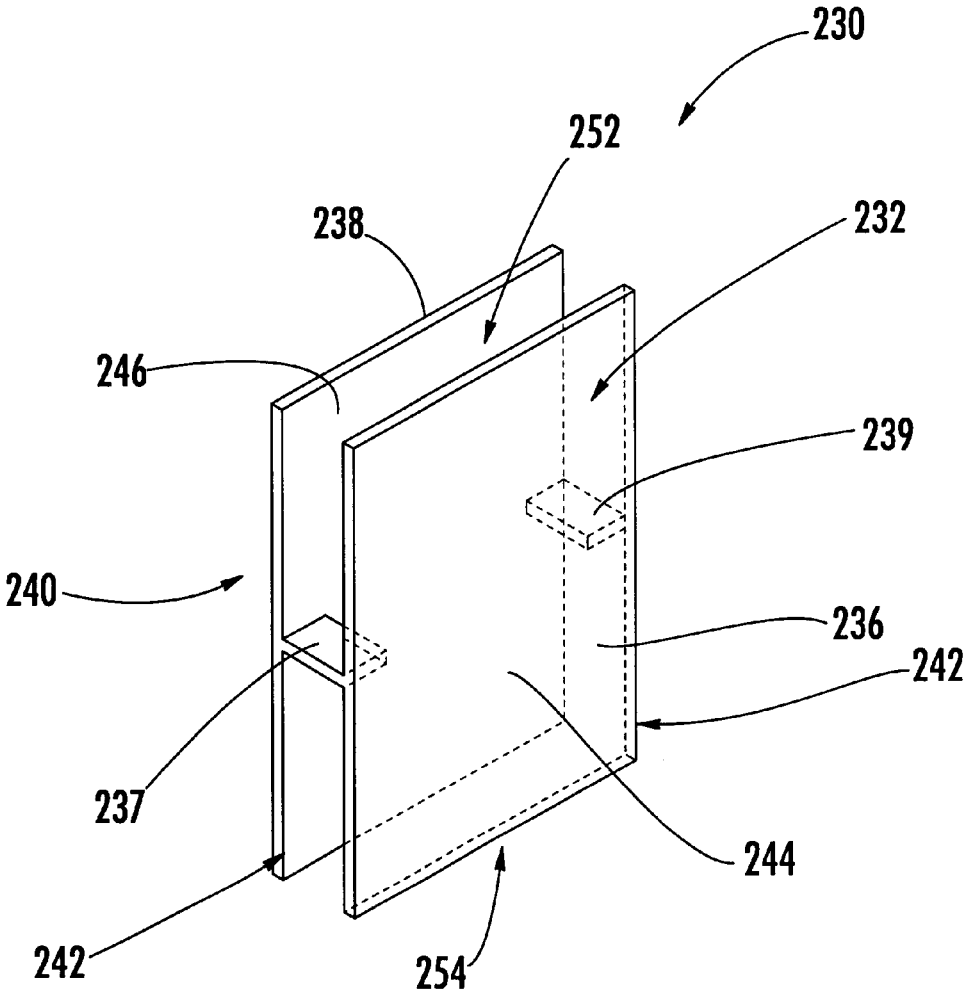
FIG. 13 is a perspective view of the third preferred embodiment of the universal fitting of the present invention showing a vertical connector fitting including a drain fitting portion which has a center opening and is adapted for placing the universal fitting between two sections of a drain.
Figure 14:
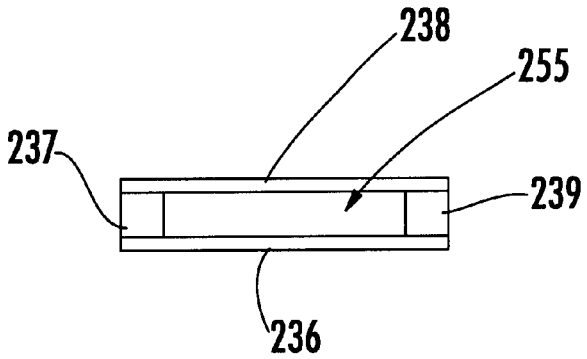
FIG. 14 is a top view of the universal vertical connector fitting of FIG. 13.
Figure 15:
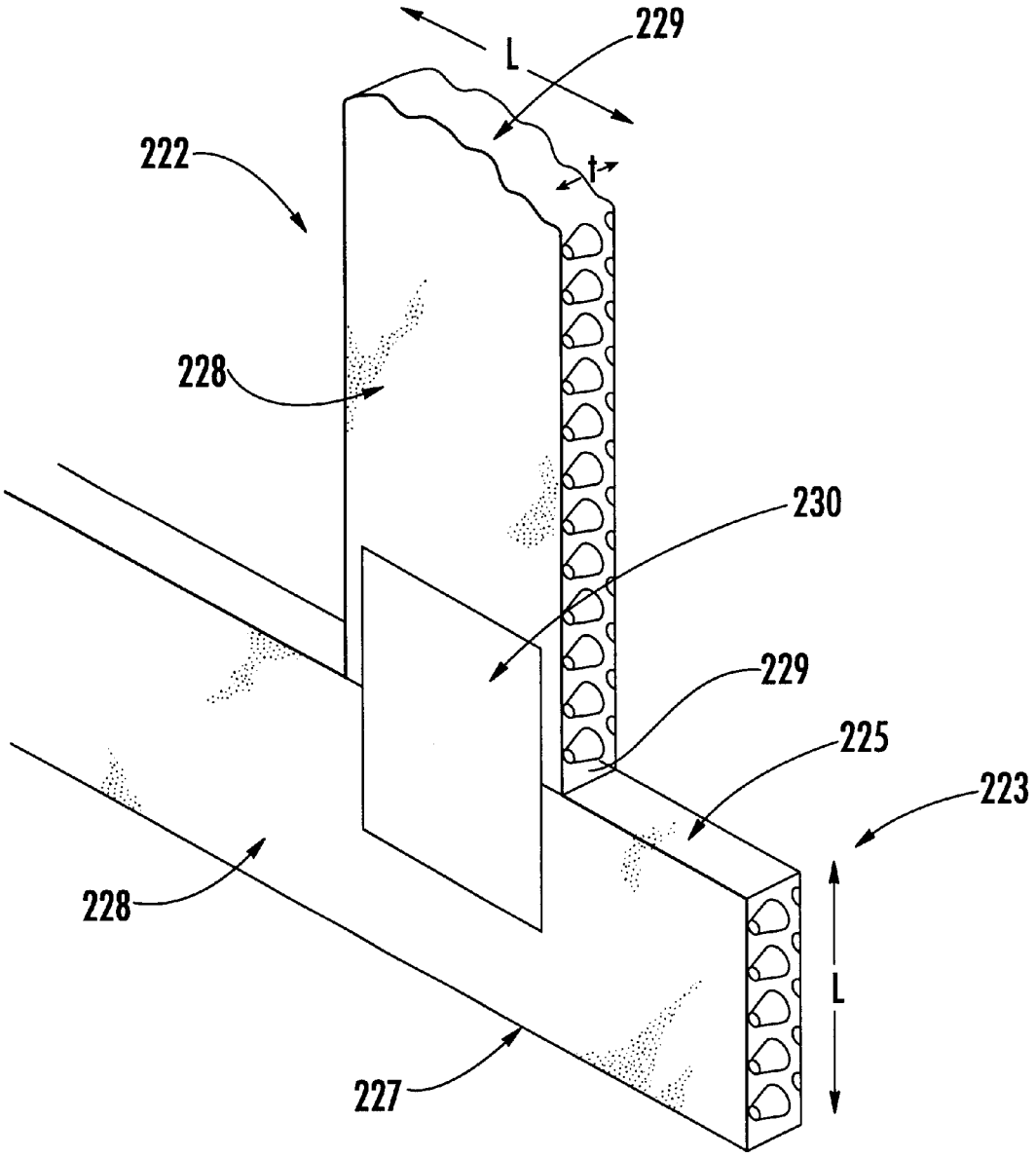
FIG. 15 is a perspective view of the universal vertical connector fitting of FIG. 13 showing the drain fitting portion of the vertical connector fitting installed to connect two sections of a drain.

In a third preferred embodiment of the present invention illustrated in FIGS. 13–15, the universal drain fitting is a universal vertical connector fitting 230 designed for joining two sections 222 and 223 of a drain in vertical alignment with one another. Each section 222 and 223 of the drain has a substantially rectangular shaped body 228 of a predetermined thickness t and includes a top 225, a bottom 227 and side ends 229, each having at least one edge of a predetermined extending length L. The universal vertical connector fitting 230 includes a drain fitting portion 232 having a width equal to or less than the extending length L of the edge of either section of the drain and which is adapted to surround a portion of the drain body 228 of each drain section 222 and 223 and make a connection between the drain sections 222, 223 regardless of the extending length L of the edge of the drain sections 222, 223.

As shown in FIGS. 13 and 14, the drain fitting portion 232 includes two walls 236, 238 disposed in a parallel relationship with one another and define an open cavity 240 between the two walls 236, 238 which has a plurality of sides 242 for receiving a portion of the sections 222, 223 of the drain. The walls 236, 238 include an outer surface 244 and an inner surface 246 and are connected by at least one tab extending between the inner surface 246 of the walls 236, 238. Thus, the sides 242 are open except for a small section on at least one side where the tab extends between the walls 236,238. In the third preferred embodiment, the walls 236,238 are substantially rectangular shaped and flat, are constructed of a lightweight material, and are connected by a pair of substantially flat tabs 237, 239 positioned near opposite sides 242 of the walls 236, 238 to define an upper cavity 252 and a lower cavity 254 for receiving a portion of the sections 222 and 223, respectively to join the sections 222, 223 together. The tabs 237, 239 are adapted to form an opening 255 between the upper cavity 252 and the lower cavity 254 for open communication therethrough. As in the first and second preferred embodiments, the walls 236, 238 may include a continuous ridge, a single protrusion or a series of discontinuous protrusions or bumps on the inner surface of at least one of the walls 236, 238 which extend into the open cavity 240 for engaging the drain fitting portion 232 on the sections 222 and 223 of the drain.

As shown in FIG. 15, the universal vertical connector fitting 230 provides a vertical connection between one of the side ends 229 of the section 222 of the drain to the top 225 of the section 223 or bottom 227 (not shown) of the section 223. While one configuration of connecting two sections of a drain is shown, it will be understood that the universal vertical connector fitting 230 may be used to connect two sections of a drain in other vertical configurations as desired by the user. The installation of the universal vertical connector fitting 230 of the third preferred embodiment may begin with the step of cutting a notch, as described above with reference to FIGS. 10 and 11, or with the step of cutting away a portion of the filter fabric from one or both exterior walls of the top 225 or bottom 227 of the drain section 222 on which the universal vertical connector will be positioned. While cutting a notch facilitates flow therethrough, the universal vertical connector fitting 230 may be installed on the drain section 222 without cutting a notch or cutting only the filter fabric from one or both exterior walls of the drain section 222. Next, the drain fitting portion 232 is positioned on the top 225 over the notch 264 of the drain section 222 such that the top 225 is received into the lower cavity 254 and the section 223 is positioned in the upper cavity 252 of the drain fitting portion 232 so that it is joined to the drain section 222 adjacent to the notch.

Figure 16:
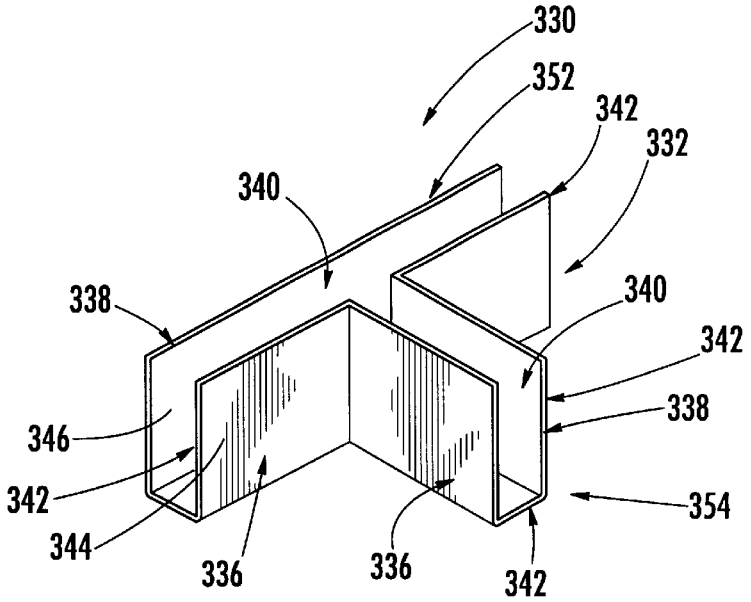
FIG. 16 is a perspective view of the fourth preferred embodiment of the universal fitting of the present invention showing a horizontal connector fitting including two drain fitting portions adapted for receiving and connecting two sections of a drain.
Figure 17:
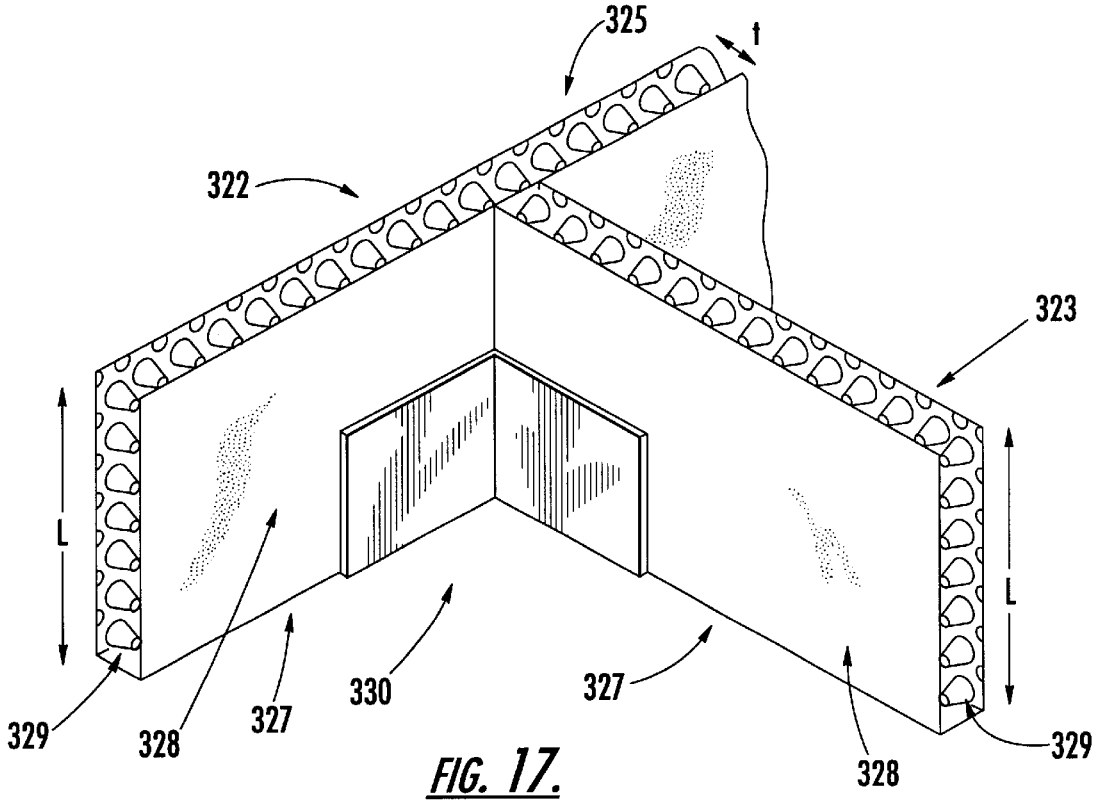
FIG. 17 is a perspective view of the universal horizontal connector fitting of FIG. 16 showing the drain fitting portions of the horizontal connector fitting installed to connect two sections of a drain.

In a fourth preferred embodiment of the present invention illustrated in FIGS. 16–17, the universal drain fitting is a universal horizontal connector fitting 330 designed for joining two sections 322 and 323 of a drain to each other in a horizontal manner. As in the third preferred embodiment, each section 322 and 323 of the drain has a substantially rectangular shaped body 328 of a predetermined thickness t and includes a top 325, a bottom 327 and side ends 329, each having at least one edge of a predetermined extending length L. The universal horizontal connector fitting 330 includes a drain fitting portion 332 with two drain section fitting portions 352, 354, each having a width equal to or less than the extending length L of the edge of either section of the drain and which is adapted to surround a portion of the drain body 328 of each drain section 322 and 323 and make a connection between the drain sections 322, 323 regardless of the extending length L of the edge of the drain sections 322, 323.

As shown in FIG. 16, the section fitting portions 352, 354 are positioned perpendicular to one another and are joined in a substantially T-shaped configuration with open communication between the open cavity 340 of each drain section fitting portion. Each drain section fitting portion includes walls 336, 338 disposed in parallel relationship to one another and each pair of walls 336, 338 define an open cavity 340 between the two walls 336,338 which has a plurality of open sides 342 with at least two open sides adjacent to one another for receiving a portion of the drain sections 322, 323 into each open cavity 340. In the fourth preferred embodiment, one of the sides 342 of each drain section fitting portion 352, 354 is closed and extends between the two walls to form a closed side. For example, with reference to FIG. 16, the closed side may be located at the top or bottom of the drain fitting portion 332. The walls 336, 338 include an inner surface 346 and an outer surface 344 and are preferably substantially rectangular shaped and flat and constructed of a semi-rigid material. In the fourth preferred embodiment, the drain section fitting portions 352,354 are integrally joined in the substantially T-shaped configuration. As in the third preferred embodiment, the walls 336, 338 of the universal horizontal connector fitting 330 may include a continuous ridge, a single protrusion or a series of discontinuous protrusions or bumps on the inner surface 346 of at least one of the walls 336, 338 which extend into at least one of the open cavities 340 for engaging the drain section fitting portions 352, 354 on the sections 322 and 323 of the drain.

As shown in FIG. 17, the universal horizontal connector fitting 330 provides a horizontal connection between one of the side ends 329 of the section 323 of the drain to the body 328 of the section 322. While the universal horizontal connector fitting 330 shown includes a closed side at the bottom of the drain fitting portion 332 and is mounted at the bottom 327 of each drain section 322, 323, it will be understood that the drain fitting portion may be positioned along the edge of the top 325, bottom 327 or side ends 329 of the sections 322, 323 of the drain but is preferably positioned on the bottom 327, as shown in FIG. 17. The installation of the universal horizontal connector fitting 330 of the fourth preferred embodiment may begin with the step of cutting a notch, as described above, or with the step of cutting away a portion of the filter fabric from one or both exterior walls near the bottom 327 of the drain section 322 on which the universal horizontal connector will be installed. While cutting a notch facilitates flow therethrough, the universal horizontal connector fitting 330 may be installed to connect sections 322, 323 of the drain without cutting a notch or cutting only the filter fabric from one or both exterior walls of the drain section 322. Next, the universal horizontal connector 330 is positioned over the notch of the drain section 322 such that the bottom 327 is received into the open cavity 340 of drain section fitting portion 352 and the section 323 is received into the open cavity 340 of the adjoining drain section fitting portion 354 for positioning the drain section 323 against section 322 adjacent to the notch.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the invention has been described herein in detail in relation to its preferred embodiment, it is to be understood that this disclosure is only illustrative and exemplary or the present invention and is made merely for purposes of provided a full and enabling disclosure of the invention. The foregoing discussion is not intended or to be construed to limit the present invention of otherwise to exclude any such other embodiments, adaptations, variations, modifications and equivalent arrangements, the present invention being limited only by the claims appended hereto and the equivalents thereof.

I claim:

1. A universal fitting for joining a prefabricated drain and a cylindrical-shaped pipe, the universal fitting comprising:

a drain fitting portion adapted to surround a portion of a drain, said drain fitting portion including two walls disposed in spaced parallel relationship to one another to define an open cavity having a plurality of sides and at least two open sides being adjacent to one another for receiving a portion of a drain into said open cavity;

a pipe fitting portion connected to and integral with said drain fitting portion and in open communication with said open cavity, said pipe fitting portion being adapted to be connected to a pipe; and wherein said drain fitting portion is adapted to connect any size drain to a pipe.

2. The universal fitting of claim 1, wherein said two walls are substantially rectangular-shaped and said plurality of sides comprise four sides defined by the space between said rectangular-shaped walls.

3. The universal fitting of claim 1, wherein said pipe fitting portion comprises a hollow cylindrical section extending outwadly from and having an axis in communication with said drain fitting portion, said cylindrical section including an intermediate connecting portion attached to said drain fitting portion and a pipe engaging portion having an opening for engaging a pipe and connecting said pipe fitting portion and a pipe.

4. The universal fitting of claim 3, wherein said two walls of said drain fitting portion have an inner surface and an outer surface, said inner surface including a ridge which extends into said open cavity for engaging said drain fitting portion on a drain and holding it in place thereat.

5. The universal fitting of claim 3, wherein said pipe fitting portion extends outwardly from one of said sides of said open cavity whereby the axis of said cylindrical section is parallel to said two walls.

6. The universal fitting of claim 5, wherein said plurality of sides of said open cavity include a closed side extending between said two walls and wherein said pipe fitting portion is adjacent to said closed side.

7. The universal fitting of claim 5, wherein said plurality of sides of said open cavity include three open sides adjacent to and in communication with one another.

8. The universal fitting of claim 3, wherein said pipe fitting portion extends outwardly from one of said two walls whereby the axis of said cylindrical section is perpendicular to said two walls.

9. The universal fitting of claim 8, wherein said plurality of sides of said open cavity includes a closed side connecting said two walls to one another and three open sides adjacent to and in communication with one another.

10. The universal fitting of claim 3, wherein said two walls of said drain fitting portion are substantially flat.

11. The universal fitting of claim 3, wherein said drain fitting portion and said pipe fitting portion are integral and constructed of a semi-rigid material.

12. A universal fitting for joining two sections of a prefabricated drain and a cylindrical-shaped pipe, the universal fitting comprising:

a drain fitting portion adapted to surround a portion of each section of a drain, said drain fitting portion including two walls disposed in spaced parallel relationship to one another to define an open cavity having a plurality of sides and at least two open sides being adjacent to one another for receiving a portion of a drain into said open cavity;

a pipe fitting portion connected to and integral with said drain fitting portion and in open communication with said open cavity, said pipe fitting portion being adapted to be connected to a pipe; and wherein said drain fitting portion is adapted to connect any size drain to a pipe.

13. The universal fitting of claim 12, wherein said pipe fitting portion comprises a hollow cylindrical section extending outwadly from and having an axis in communication with said drain fitting portion, said cylindrical section including an intermediate connecting portion attached to said drain fitting portion and a pipe engaging portion having an opening for engaging a pipe and connecting said pipe fitting portion and a pipe.

14. The universal fitting of claim 13, wherein said two walls are substantially rectangular-shaped having opposite sides, a top and a bottom and said plurality of sides of said open cavity comprise four sides defined by the space between said rectangular-shaped walls.

15. The universal fitting of claim 14, wherein said plurality of sides of said open cavity include at least one member extending between said two walls for connecting said two walls to one another.

16. The universal fitting of claim 15, wherein said member comprises a narrow, substantially flat strip extending between the two walls.

17. The universal fitting of claim 15, wherein said pipe fitting portion extends outwardly from one of said two walls whereby the axis of said cylindrical section is perpendicular to said two walls.

18. A universal fitting for joining sections of a prefabricated drain, the universal fitting comprising:

a drain fitting portion adapted to surround a portion of the sections of a drain, said drain fitting portion including two walls disposed in spaced parallel relationship to one another to define an open cavity having a plurality of sides and at least two open sides being adjacent to one another for receiving a portion of a drain into said open cavity; and wherein said drain fitting portion is adapted to connect sections of any size drain to one another.

19. The universal fitting of claim 18, further including at least one tab for connecting said two walls together, said tab defining an upper cavity above the tab and a lower cavity below the tab of said open cavity, said upper cavity for receiving one section of a drain and said lower cavity for receiving another section of a drain for joining the sections in vertical alignment with one another.

20. The universal fitting of claim 19, wherein said two walls are substantially rectangular-shaped and said plurality of sides comprise four sides defined by the space between said rectangular-shaped walls.

21. The universal fitting of claim 20, wherein said at least one tab includes a pair of tabs at opposite sides of said walls tabs 237,239 defining an opening between said upper cavity and said lower cavity for open communication therethrough.

22. The universal fitting of claim 18, wherein said drain fitting portion includes at least two drain section fitting portions each including two walls disposed in spaced parallel relationship to one another to define an open cavity having a plurality of sides and at least two open sides being adjacent to one another for receiving a portion of a section of a drain into said open cavity of each drain section fitting portion; and wherein said drain section fitting portions are adapted to join at least two sections of any size drain in horizontal alignment with one another.

23. The universal fitting of claim 22, wherein said at least two drain section fitting portions include two drain section fitting portions in a substantially T-shaped configuration having open communication between the open cavity of each drain section fitting portion.

24. The universal fitting of claim 23, wherein said two walls of each drain section fitting portion are substantially rectangular-shaped and said plurality of sides comprise four sides defined by the space between said rectangular-shaped walls and said plurality of sides of said open cavity of each drain section fitting portion include a closed side extending between said two walls and two open sides adjacent to and in communication with one another.

* * * * *